US011359643B2

(12) United States Patent
Seasholtz et al.

(10) Patent No.: US 11,359,643 B2
(45) Date of Patent: Jun. 14, 2022

(54) FAN HAVING HOUSING FORMED BY CONNECTABLE PIECES AND INCLUDING AIR GUIDE RIBS AND AN INTERNAL RAMP

(71) Applicant: SHOP VAC CORPORATION, Williamsport, PA (US)

(72) Inventors: Craig A. Seasholtz, Avis, PA (US); David Martinez, Williamsport, PA (US); Scott G. Smith, Muncy, PA (US); Melvin E. Wolfe, Jr., Johnson City, NY (US)

(73) Assignee: SHOP VAC CORPORATION, Williamsport, PA (US)

( * ) Notice: Subject to any disclaimer, the term of this patent is extended or adjusted under 35 U.S.C. 154(b) by 299 days.

(21) Appl. No.: 15/925,824

(22) Filed: Mar. 20, 2018

(65) Prior Publication Data

US 2018/0266437 A1 Sep. 20, 2018

Related U.S. Application Data

(60) Provisional application No. 62/597,540, filed on Dec. 12, 2017, provisional application No. 62/473,553, filed on Mar. 20, 2017.

(51) Int. Cl.
*F04D 29/54* (2006.01)
*F04D 19/00* (2006.01)
(Continued)

(52) U.S. Cl.
CPC ..... *F04D 29/541* (2013.01); *F04D 19/002* (2013.01); *F04D 25/08* (2013.01);
(Continued)

(58) Field of Classification Search
CPC ..... F04D 29/703; F04D 29/646; F04D 25/08; F04D 19/002; F04D 29/164; F04D 29/547; F04D 29/541; F04D 29/526; F04D 29/34
See application file for complete search history.

(56) References Cited

U.S. PATENT DOCUMENTS 2,633,293 A * 3/1953 Jones ..... F04D 29/646 417/234
2,776,089 A * 1/1957 Burrowes ..... F04D 29/646 417/338
(Continued)

FOREIGN PATENT DOCUMENTS

CN 203835799 U 9/2014
CN 203835804 U 9/2014
(Continued)

OTHER PUBLICATIONS

ULINE, "H-6984 Drum Fan—30 Parts List" (Year: ?).*
International Search Report and Written Opinion for Application No. PCT/US2018/023222 dated Aug. 27, 2018.

*Primary Examiner* — Courtney D Heinle
*Assistant Examiner* — Andrew Thanh Bui
(74) *Attorney, Agent, or Firm* — Marshall, Gerstein & Borun LLP

(57) ABSTRACT

A fan having a housing including a front piece that is separable but connectable to a back piece is disclosed. The front piece has a first connecting edge and a downstream edge, and the back piece has a second connecting edge and an upstream edge. The second connecting edge is configured to be connected to the first connecting edge. The fan may include a handle, the handle having a first portion integral with the front piece and a second portion integral with the back piece, the first portion configured to be connected to the second portion. The fan may further include air guide ribs
(Continued)

provided on an interior surface of the housing and/or a ramp that starts at a location downstream of the upstream edge of the housing and ends at the downstream edge of the housing.

12 Claims, 18 Drawing Sheets

(51) Int. Cl.

| | |
|---|---|
| ***F04D 29/70*** | (2006.01) |
| ***F04D 29/64*** | (2006.01) |
| ***F04D 29/56*** | (2006.01) |
| ***F04D 29/52*** | (2006.01) |
| ***F04D 25/08*** | (2006.01) |

(52) U.S. Cl.
CPC ..... *F04D 29/526* (2013.01); *F04D 29/547* (2013.01); *F04D 29/563* (2013.01); *F04D 29/646* (2013.01); *F04D 29/703* (2013.01); *F05D 2250/181* (2013.01)

(56) References Cited

U.S. PATENT DOCUMENTS

| | | | | |
|---|---|---|---|---|
| 2,950,859 | A * | 8/1960 | Kirk | F04D 29/703 417/363 |
| 3,044,689 | A * | 7/1962 | Alldritt | F04D 29/646 417/362 |
| 3,173,478 | A * | 3/1965 | Maycen | F28D 1/024 165/121 |
| 3,173,605 | A * | 3/1965 | Harris | F04D 29/547 415/207 |
| 4,167,376 | A | 9/1979 | Papst | |
| 4,895,489 | A | 1/1990 | Kohama et al. | |
| 4,927,324 | A * | 5/1990 | Coup | F04D 25/08 415/121.2 |
| D341,196 | S | 11/1993 | Cheslock | |
| D358,639 | S | 5/1995 | Chiu | |
| 5,441,391 | A * | 8/1995 | Frost | F04D 19/002 417/362 |
| 5,707,205 | A | 1/1998 | Otsuka | |
| 5,829,956 | A * | 11/1998 | Chen | B63H 1/14 416/196 A |
| D412,743 | S | 8/1999 | Litvin et al. | |
| 5,944,488 | A * | 8/1999 | Matson | F04D 29/703 415/121.2 |
| D416,617 | S | 11/1999 | Jane'et al. | |
| D424,681 | S | 5/2000 | Lozzio et al. | |
| D426,631 | S | 6/2000 | Thakur | |
| D429,809 | S | 8/2000 | Wolfe | |
| D442,274 | S | 5/2001 | Lee et al. | |
| 6,283,709 | B1 | 9/2001 | Hill et al. | |
| 6,336,793 | B1 | 1/2002 | Litvin | |
| 6,394,766 | B1 | 5/2002 | Gill et al. | |
| D466,606 | S | 12/2002 | Shapiro | |
| 6,710,486 | B1 | 3/2004 | Horng et al. | |
| D538,920 | S | 3/2007 | Russak et al. | |
| 7,284,960 | B2 | 10/2007 | Aynsley | |
| D559,381 | S | 1/2008 | Shapiro | |
| D571,447 | S | 6/2008 | Russak et al. | |
| D571,448 | S | 6/2008 | Bucher et al. | |
| 7,391,611 | B2 | 6/2008 | Ko et al. | |
| D602,580 | S | 10/2009 | Sterpka et al. | |
| D610,673 | S | 2/2010 | Sterpka et al. | |
| D635,237 | S | 3/2011 | Fizer | |
| D638,924 | S | 5/2011 | Perez et al. | |
| D650,893 | S | 12/2011 | Fizer | |
| 8,079,823 | B2 | 12/2011 | Aynsley | |
| 8,147,204 | B2 | 4/2012 | Scherer et al. | |
| 8,210,824 | B1 * | 7/2012 | Bucher | F04B 33/00 416/210 R |
| D673,256 | S | 12/2012 | Shapiro | |
| D676,953 | S | 2/2013 | Hollan et al. | |
| 8,529,212 | B2 | 9/2013 | Smith et al. | |
| 8,732,930 | B1 | 5/2014 | Bucher et al. | |
| 9,458,859 | B2 | 10/2016 | Fizer | |
| 10,054,131 | B2 * | 8/2018 | Aynsley | F04D 29/20 |
| 2005/0202776 | A1 | 9/2005 | Avedon | |
| 2005/0271516 | A1 * | 12/2005 | Chang | F04D 29/703 416/247 R |
| 2010/0247316 | A1 | 9/2010 | Aynsley et al. | |
| 2011/0142614 | A1 * | 6/2011 | Kato | F04D 29/526 415/220 |
| 2011/0293415 | A1 * | 12/2011 | He | F04B 35/06 415/220 |
| 2012/0082561 | A1 | 4/2012 | Gammack et al. | |
| 2012/0294710 | A1 * | 11/2012 | Lee | F04D 25/08 415/203 |
| 2013/0136591 | A1 | 5/2013 | Yen et al. | |
| 2013/0189109 | A1 | 7/2013 | Noble | |
| 2014/0072431 | A1 | 3/2014 | Smith et al. | |
| 2015/0037164 | A1 | 2/2015 | Fizer et al. | |
| 2015/0064029 | A1 | 3/2015 | Higuchi et al. | |

FOREIGN PATENT DOCUMENTS

| | | | |
|---|---|---|---|
| EP | 2503159 | A2 | 9/2012 |
| EP | 3009682 | A1 | 4/2016 |
| WO | WO-2008124656 | A1 | 10/2008 |
| WO | WO-2013152014 | A1 | 10/2013 |
| WO | WO-2016201455 | A1 | 12/2016 |

* cited by examiner

FAN HAVING HOUSING FORMED BY CONNECTABLE PIECES AND INCLUDING AIR GUIDE RIBS AND AN INTERNAL RAMP

CROSS-REFERENCE TO RELATED APPLICATIONS

This application claims the benefit of the filing date of U.S. Provisional Appl. No. 62/473,553, filed Mar. 20, 2017, which is hereby incorporated by reference. This application also claims the benefit of the filing date of U.S. Provisional Appl. No. 62/597,540, filed Dec. 12, 2017, which is hereby incorporated by reference.

FIELD OF THE DISCLOSURE

This application relates generally to fans and, more specifically, to features of fans that guide the airflow or allow manufacturing of the fans using molded parts.

BACKGROUND

Conventional axial fans commonly include a housing surrounding fan blades. The fan blades are rotated around a central hub, causing air to flow through the housing from an upstream side of the housing to a downstream side of the housing. Additional developments are desirable in order to more effectively move air through the housing of an axial fan. Additional developments are also desirable to facilitate manufacturing and different designs of the housing. In particular, designs that maximize the structural integrity of the housing are desirable in order to prevent the bending and twisting that undesirably occurs to molded parts of conventional axial fans.

SUMMARY

According to some aspects of the disclosure, a fan comprises fan blades rotatably connected to a central hub, a housing surrounding the fan blades having an interior surface, an upstream edge in the direction of air flow, and a downstream edge in the direction of air flow. The housing may be cylindrical. The central hub is located in a mounting bracket, and a motor is operably connected to the fan blades. The interior surface of the housing is connected to the mounting bracket, and the housing has an exterior surface forming an outside of the housing. The housing may have a front piece having a first connecting edge and the downstream edge and a back piece having a second connecting edge and the upstream edge. The back piece may be separable from the front piece, and the second connecting edge may be configured to be connected to the first connecting edge.

The fan may include a handle, the handle having a first portion integral with the front piece and a second portion integral with the back piece, the first portion configured to be connected to the second portion. The first portion of the handle may have a bottom opening projection and an upper opening projection. The second portion of the handle may have a bottom opening extension and an upper opening extension. The bottom opening projection and the upper opening extension may overlap when the front piece and the back piece are connected. The upper opening projection may be fastened to the upper opening extension by a fastener. The fan may comprise two handles.

An outer lip may extend outwardly from the exterior surface of the front piece. The back piece may include an inner lip extending outwardly from the exterior surface of the back piece and configured for insertion below the outer lip of the front piece when the front piece and back piece are connected. The bottom opening projection of the first portion of the handle may be adjacent to the outer lip of the front piece. The bottom opening projection of the first portion of the handle and the outer lip may extend an equal axial distance beyond the first connecting edge of the front piece.

Housing connection ports may be provided for fastening the front piece to the back piece with a fastener. In some arrangements, each housing connection port may comprise a first hole in the outer lip of the front piece for the fastener and a fastening block extending outwardly from the exterior surface of the back piece and configured for insertion below the outer lip of the front piece when the front piece and back piece are connected, the fastening block comprising a second hole for the fastener.

The housing may have open sides. Grills may cover the open sides of the housing, and grill ports may be provided adjacent the downstream edge of the front piece and the upstream edge of the back piece for receiving brackets for securing the grills relative to the housing. Grill ports provided adjacent the upstream edge may be connected to the interior surface of the back piece. Grill ports provided adjacent the downstream edge may be located between the interior surface and the exterior surface.

Air guide ribs may be provided on the interior surface of the housing, wherein the air guide ribs are axially aligned with the central hub and extend from upstream of the fan blades toward the downstream edge of the housing. The air guide ribs reduce the natural cyclonic action of the swirling air created by the fan blades and redirect it more linearly toward the downstream edge of the fan. This allows the air to be expelled at a higher velocity and to travel a greater distance from the fan, facilitating dispersal of the air. Additional arrangements may include the air guide ribs being uniformly distributed around the circumference of the interior surface of the housing. In some arrangements, the air guide ribs may be integrally formed with the housing. In other arrangements, the air guide ribs are separate from the housing and adjustably secured to the interior surface of the housing. The interior surface of the housing has a width between the upstream edge and the downstream edge and, in some arrangements, the air guide ribs may have a length between 35 and 47 percent of the width of the housing. The air guide ribs may be provided on the interior surface of the housing within a half of the width of housing closest to the downstream edge.

The interior surface may have a ramp starting a location downstream of the upstream edge and ending at the downstream edge. The ramp may be supported by struts located between the interior surface and the exterior surface of the housing that are axially aligned with the central hub and distributed around the circumference of the housing. The ramp acts to concentrate air flowing through the fan. As a result, the column of air exhausted from the fan is narrower and faster in velocity, facilitating dispersal of the air. The interior surface of the housing has a width between the upstream edge and the downstream edge, and in some arrangements, the location at which the ramp starts may be within a half of the width of housing closest to the downstream edge. Arrangements may include a cross-sectional area inside the interior surface of the housing at the upstream edge being greater than a cross-sectional area inside the interior surface of the housing at the downstream edge. The ramp may be concave and may have an initial angle between 0 and 5 degrees at the location where the ramp starts and a final angle between 30 and 40 degrees at the downstream edge. More specifically, the ramp may have an initial angle of 1 degree and a final angle of 35 degrees. Alternately, the ramp may be convex, linear at an angle, may include multiple linear angles, or may be a combination of curved and linear shapes.

In some arrangements, the front piece may further include a first foot integral with the front piece, the back piece may further include a second foot integral with the back piece, and the first foot and the second foot may be aligned symmetrically when the front piece and back piece are connected. In some arrangements, the fan may further comprise two wheels connected by an axle, the axle extending through an axle bracket having a first section integral with the front piece and a second section integral with the second piece. In some arrangements, the fan may further comprise an on/off switch electrically connected to the motor, the on/off switch secured in an aperture in the back piece.

DETAILED DESCRIPTION OF THE DRAWINGS

Figure 1:
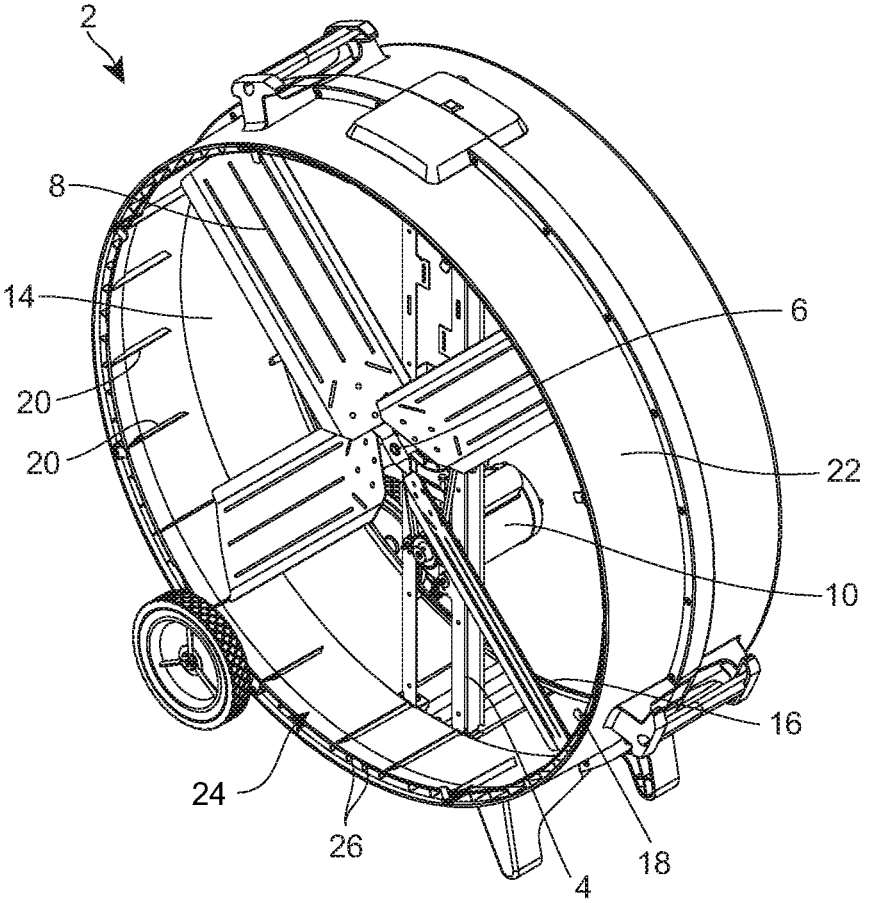
FIG. 1 is an isometric view of a fan of the present invention.
Figure 2:
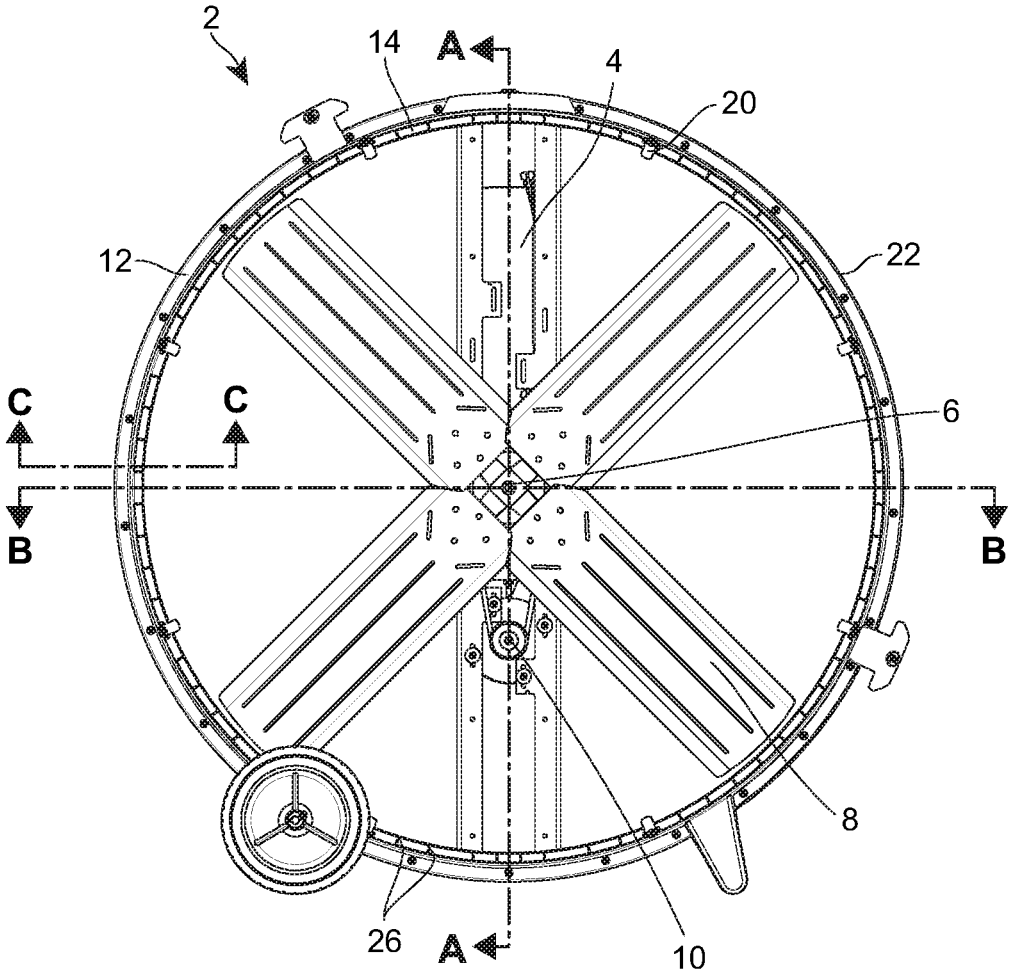
FIG. 2 is a front view of the fan depicted in FIG. 1.

Referring now to the exemplary arrangement shown in FIGS. 1 and 2, a fan 2 comprises a mounting bracket 4 having a central hub 6. Fan blades 8 are rotatably connected to the central hub 6 of the mounting bracket 4. A motor 10 is operably connected to the fan blades 8 for causing rotation of the fan blades 8 in order to move air through the fan 2. A housing 12 surrounds the fan blades 8. The mounting bracket 4 keeps the central hub 6 in a generally fixed location with respect to the housing. The housing 12 is generally cylindrical, though other shapes may be used. The housing 12 has an interior surface 14 connected to the mounting bracket 4 and an exterior surface 22 forming an outside of the housing 12. As shown in FIG. 1, the housing 12 also has an upstream edge 16 in the direction of airflow and a downstream edge 18 in the direction of airflow. Air guide ribs 20 are provided on the interior surface 14 of the housing 12. The air guide ribs 20 are axially aligned with the central hub 6 of the mounting bracket 4. The air guide ribs 20 extend from upstream of the fan blades 8 toward the downstream edge 18 of the housing 12. Grate covers (not pictured in FIGS. 1 and 2) may be attached to upstream edge 15 and downstream edge 18 of the housing 12.

In FIGS. 1 and 2, the air guide ribs 20 are uniformly distributed around the circumference of the interior surface 14 of the housing 12. In other arrangements not pictured, the air guide ribs 20 may not be uniformly distributed. In arrangements in which the air guide ribs 20 are not uniformly distributed, patterns may inform the distribution of the air guide ribs 20. For example, two air guide ribs may be placed close together, followed by a single air guide rib a distance away, followed at that same distance by another set of two air guide ribs placed close together, and so on. In the arrangement shown in FIGS. 1-5, the air guide ribs 20 are integrally formed with the housing 12. In other arrangements not herein depicted, the air guide ribs 20 are separate from the housing 12 and may be adjustably secured to the interior surface 14 of the housing 12. The air guide ribs 20 may or may not all be the same length, the same width, or the same height. In some embodiments, differing sized sets of air guide ribs 20 may be interspersed with each other such that, for example, every other air guide rib 20 is longer than the air guide ribs 20 to which it is immediately adjacent.

As shown in FIG. 1, the interior surface 14 also has a ramp 24 starting at a location downstream of the upstream edge and ending at the downstream edge. The ramp 24 is supported by struts 26 located between the interior surface 14 and the exterior surface 22 of the housing 12. As shown in FIGS. 1 and 2, the struts 26 are axially aligned with the central hub and distributed around the circumference of the housing 12. The struts 26 may or may not be uniformly distributed. The thickness of each strut 26 may vary. For example, the thickness of each strut 26 may correlate with the structural load carried by each strut 26, such that struts 26 at the bottom of the fan 2 are thicker than struts 26 at the top of the fan 2.

Figure 3:
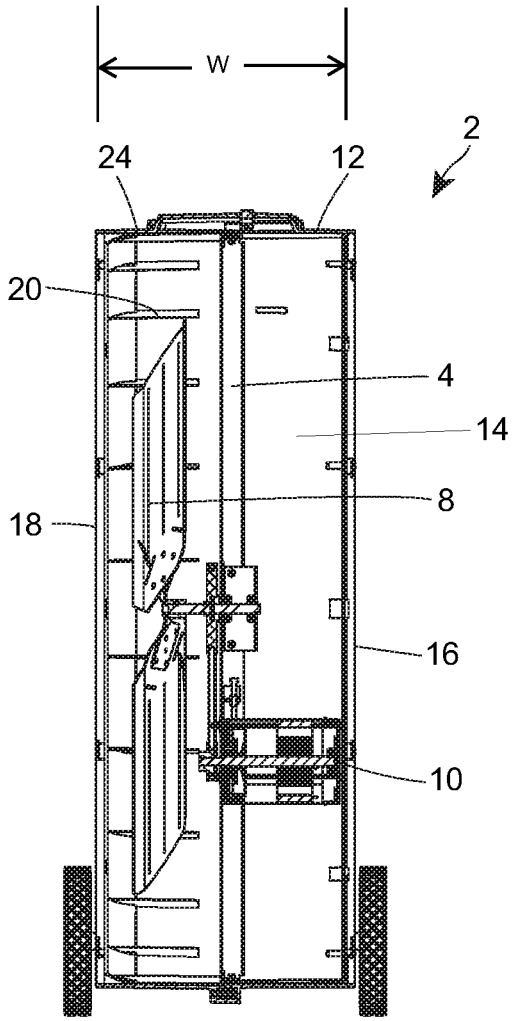
FIG. 3 is a side cross-sectional view of the fan depicted in FIGS. 1 and 2 taken along line A-A in FIG. 2.
Figure 4:
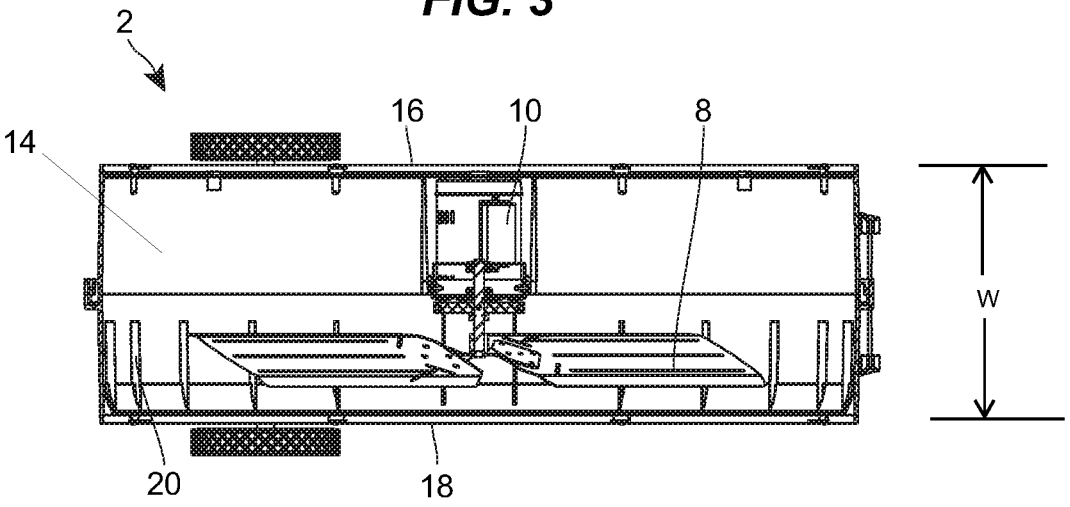
FIG. 4 is a top cross-sectional view of the fan depicted in FIGS. 1-3 taken along line B-B in FIG. 2.

Referring now to FIGS. 3 and 4, the interior surface 14 of the housing 12 has a width w between the upstream edge 16 and the downstream edge 18. The air guide ribs 20 may have a length between 35 and 47 percent of the width of the housing 12. In the arrangement depicted in FIGS. 1-5, the air guide ribs 20 are provided on the interior surface 14 of the housing 12 within the half of the width of the housing 12 closest to the downstream edge 18. In the arrangement depicted in FIGS. 1-5, the location at which the ramp 24 starts is within the half of the width of the housing 12 closest to the downstream edge 18. In other arrangements not herein depicted, the location at which the ramp 24 starts may be within the half of the width of the housing 12 closest to the upstream edge 16.

Figure 5:
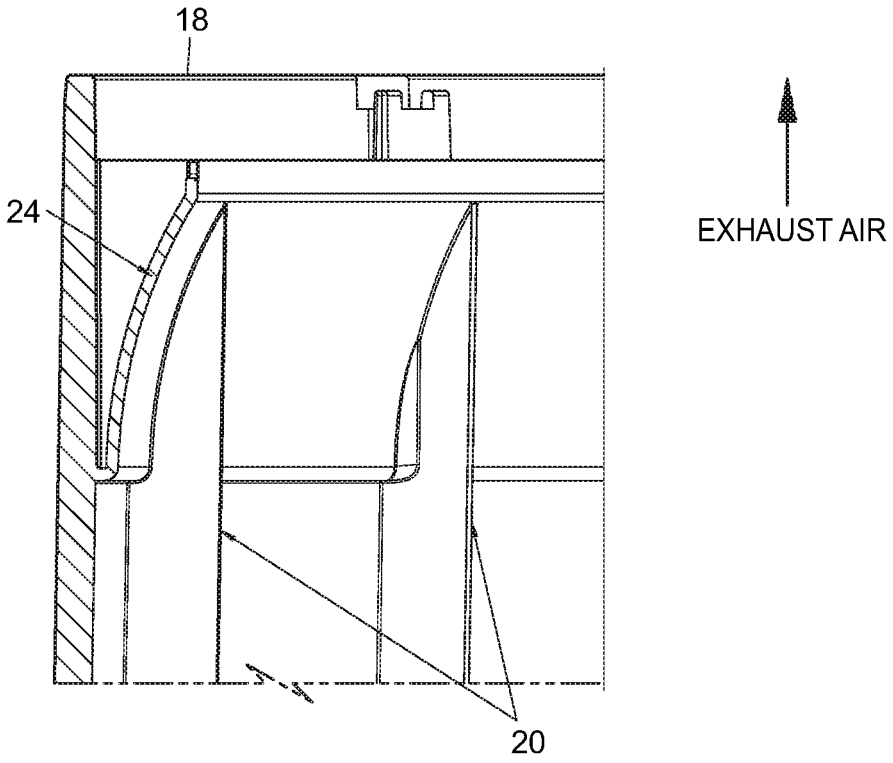
FIG. 5 is a partial bottom cross-sectional view of the fan depicted in FIGS. 1-4 taken along line C-C in FIG. 2.

Referring now to FIG. 5, the ramp 24 starts at a location downstream of the upstream edge 16 (not pictured) and ends at the downstream edge 18. As a result, the cross-sectional area inside the interior surface 14 of the housing 12 at the upstream edge 16 is greater than the cross-sectional area inside the interior surface 14 of the housing 12 at the downstream edge 18. The ramp 24 is concave and has an initial angle between 0 and 5 degrees at the location where the ramp 24 starts and a final angle between 30 and 40 degrees at the downstream edge 18. More specifically, the ramp 24 has an initial angle of 1 degree and a final angle of 35 degrees. Alternately, the ramp 24 may be convex, linear at an angle, may include multiple linear angles, or may be a combination of curved and linear shapes.

Figure 6:
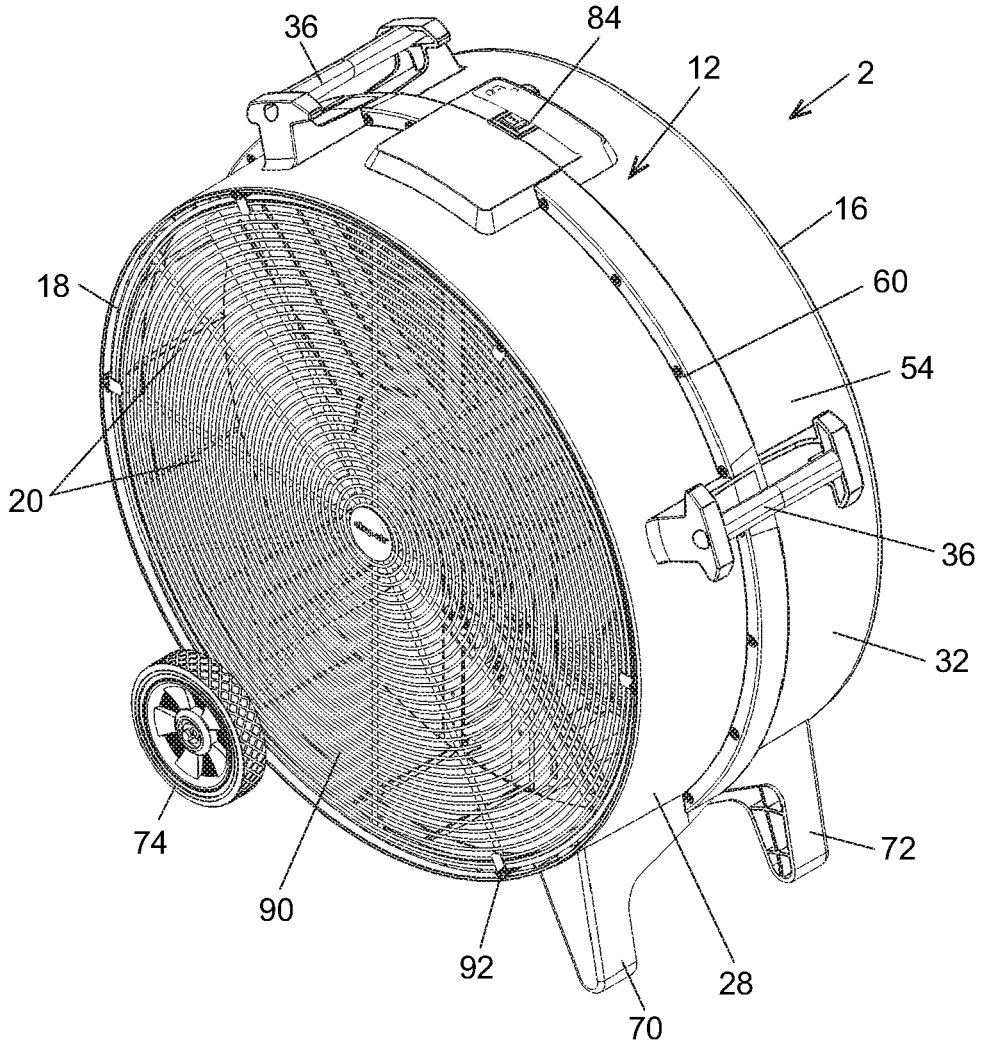
FIG. 6 is an isometric view of the fan of the present disclosure depicted in FIGS. 1-5 having grills secured at grill ports in a position relative to the housing.
Figure 12:
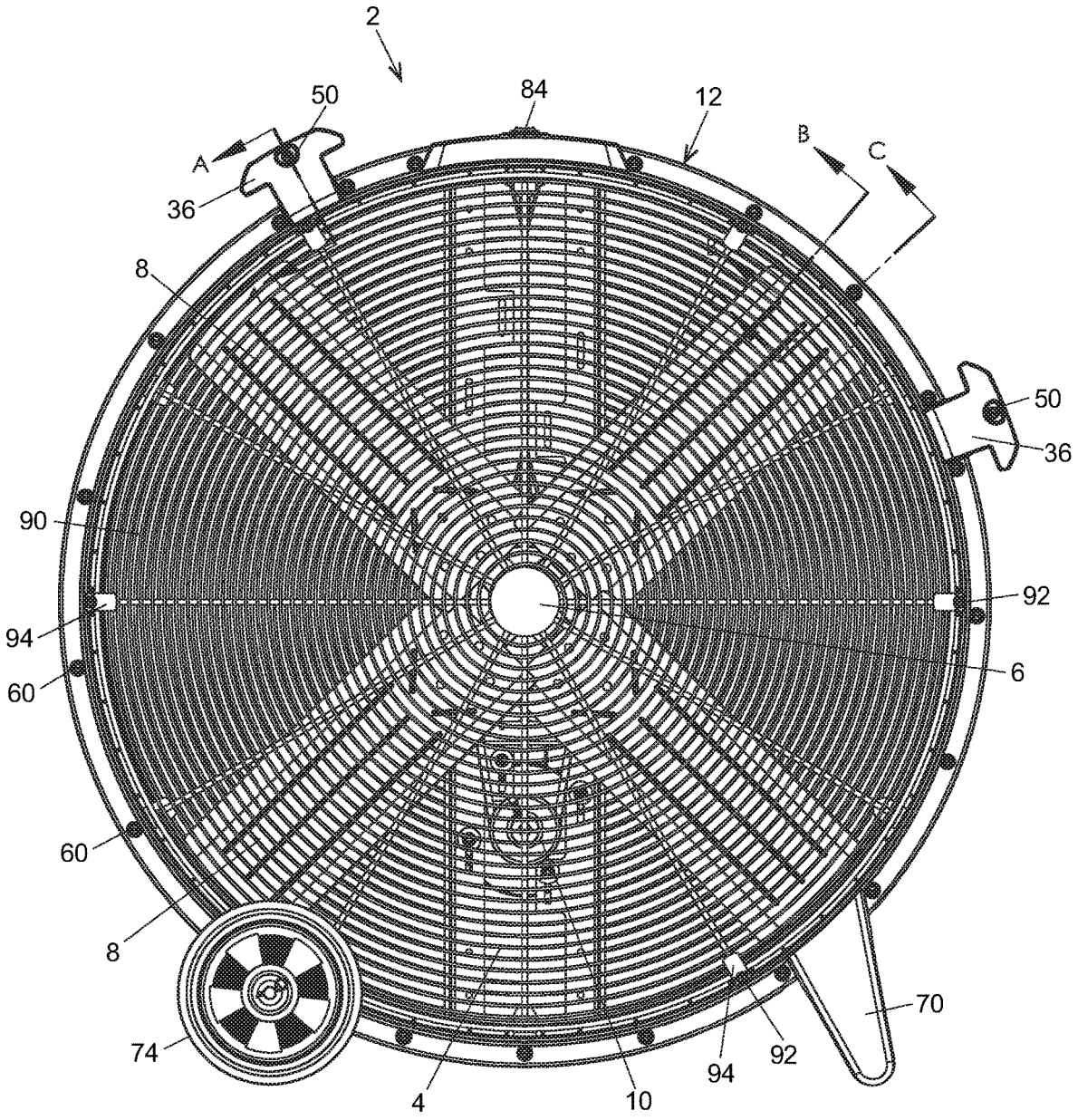
FIG. 12 is a front view of the fan depicted in FIGS. 6-11.
Figure 15:
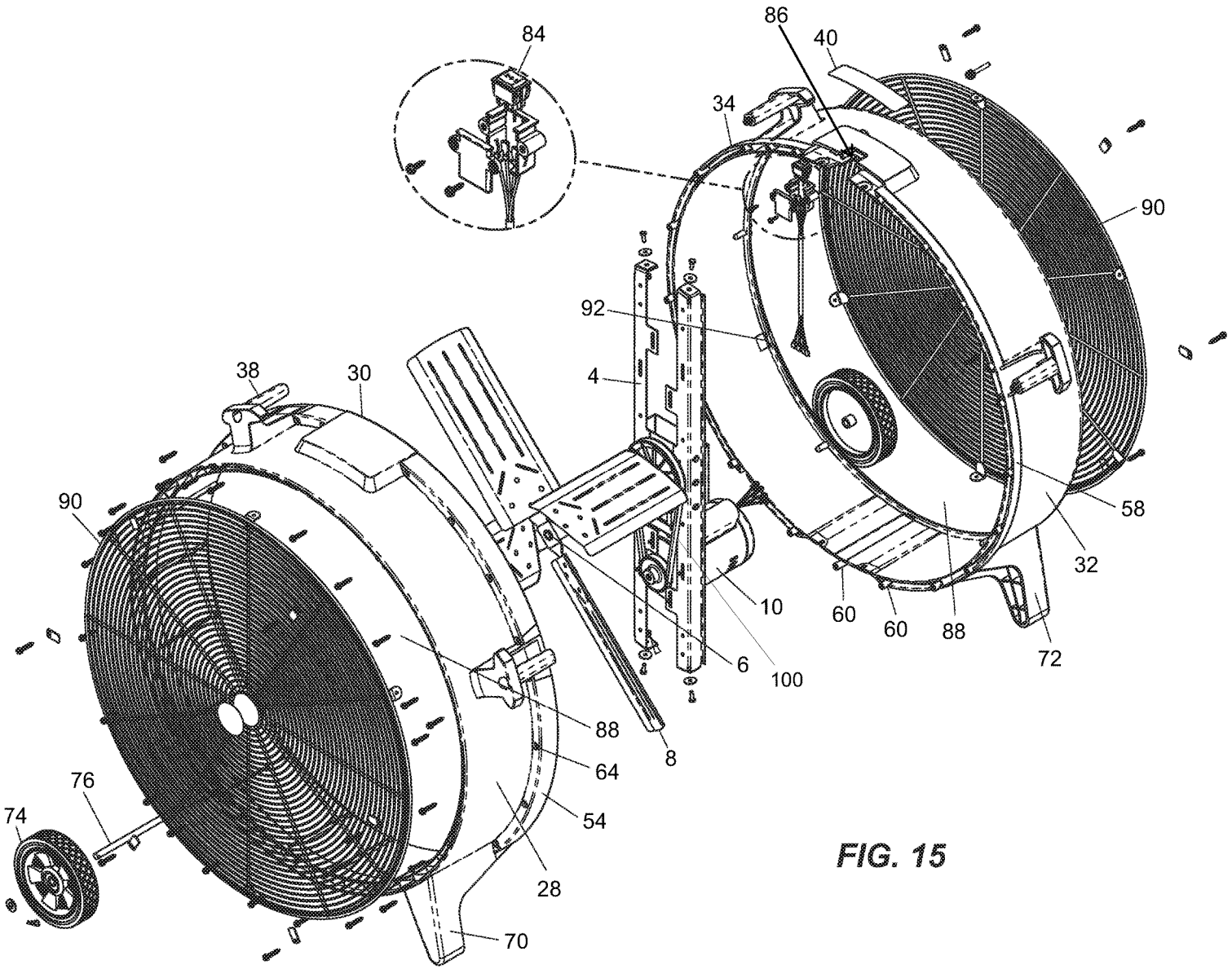
FIG. 15 is an exploded isometric view of the fan depicted in FIGS. 6-15.
Figure 18:
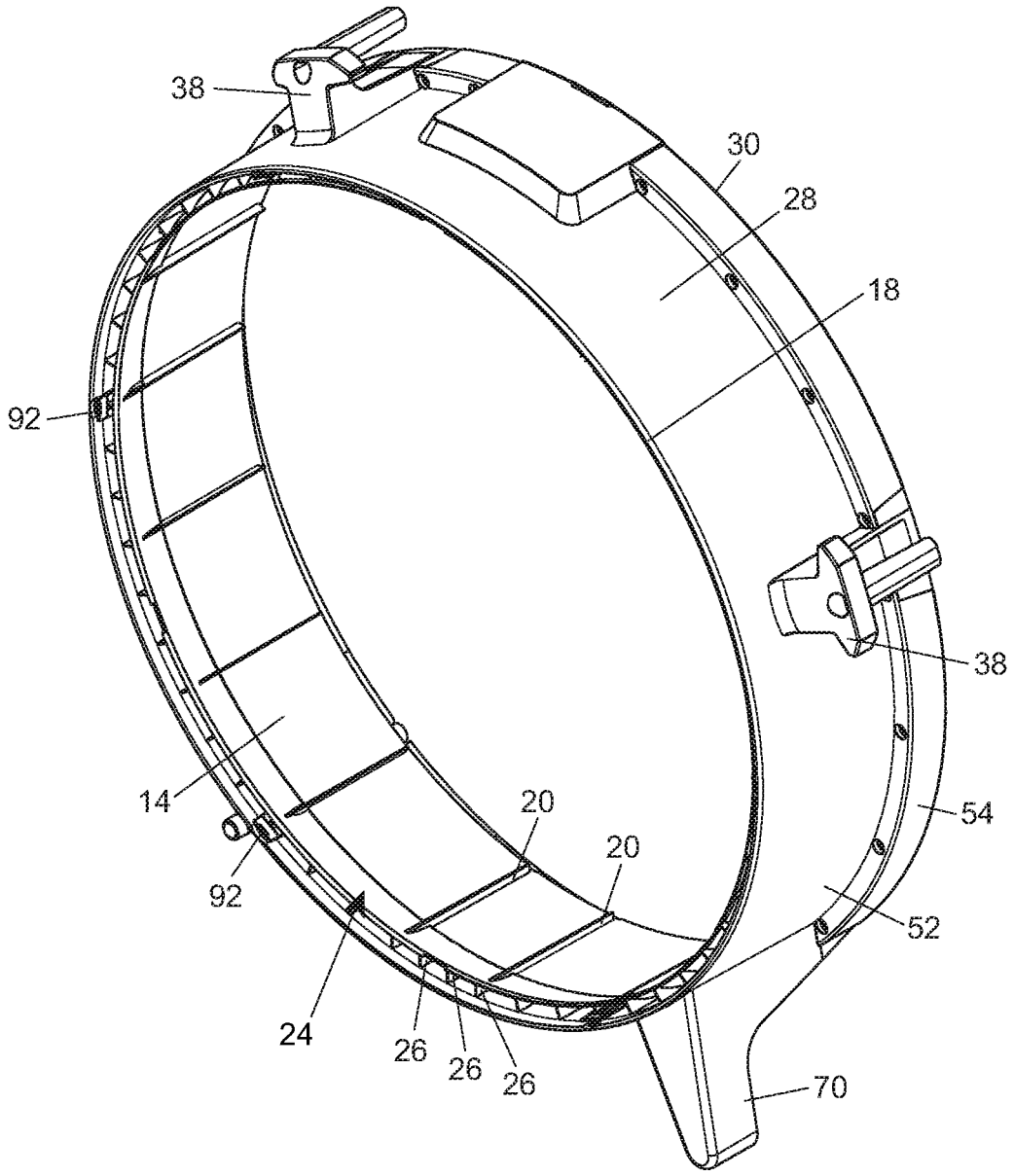
FIG. 18 is a front isometric view of a front of a fan of the present disclosure having air guide ribs and a ramp.
Figure 19:
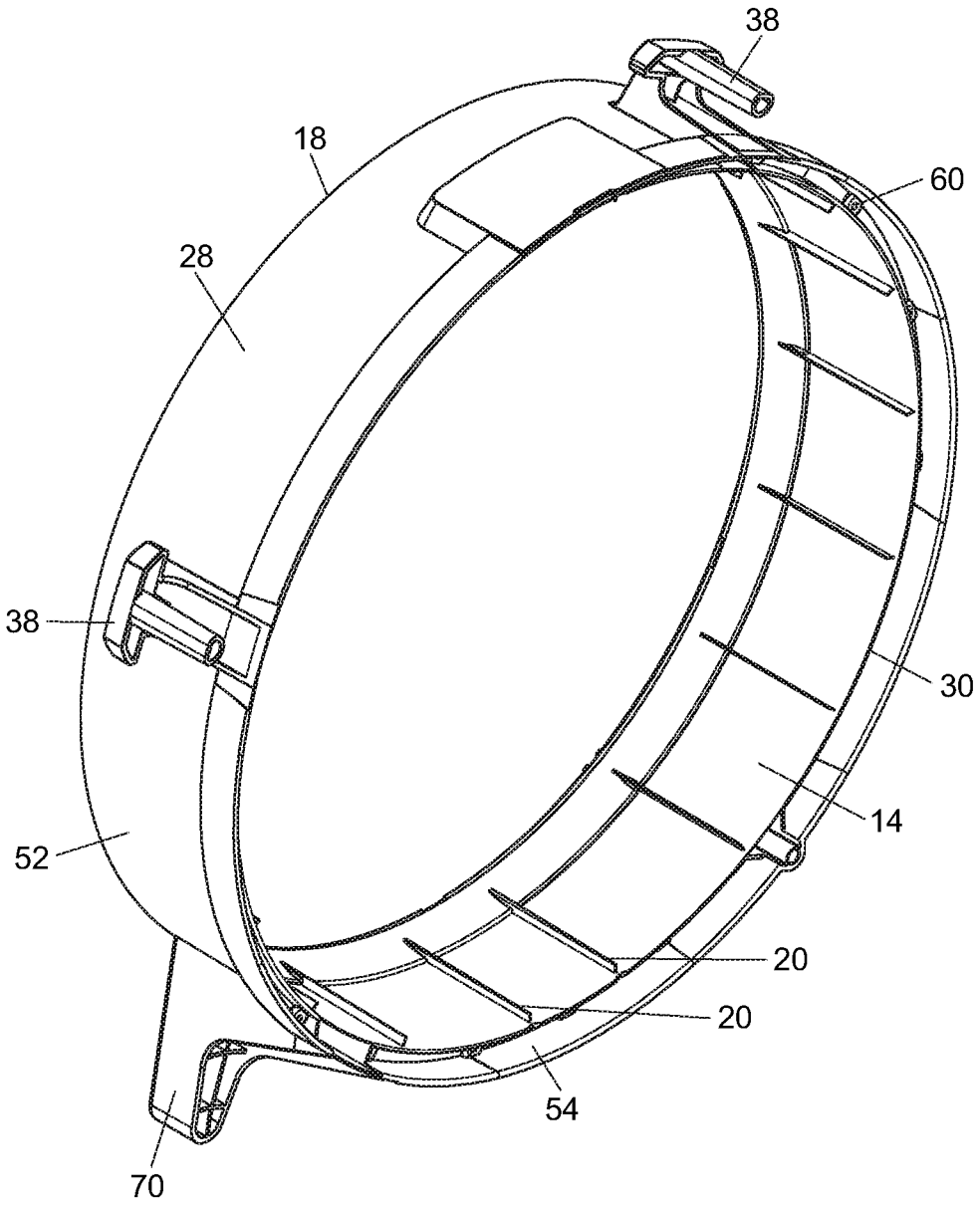
FIG. 19 is a back isometric view of the front of the fan depicted in FIG. 18.

Referring now to FIG. 6, the fan 2 comprises the housing 12 having a front piece 28 and a back piece 32. The back piece 32 is separable from the front piece 28. Each of the front piece 28 and back piece 32 are generally cylindrical in shape, though other shapes may be used. As best seen in FIGS. 15, 18, and 19, the front piece 28 has a first connecting edge 30 and the downstream edge 18. The front piece 28 also has an exterior surface 52 and an outer lip 54 extending outwardly from the exterior surface 52, as well as open sides 88. As shown in FIG. 15, the back piece 32 has a second connecting edge 34 and the upstream edge 16. The back piece 32 also has an exterior surface 56 and an inner lip 58 extending outwardly from the exterior surface 56, as well as open sides 88. As shown in FIG. 12, the housing 12 surrounds fan blades 8, which are rotatably connected to the central hub 6 of the mounting bracket 4. The motor 10 is operably connected to the fan blades 8 through a fan belt 100 (shown in FIG. 15), though the motor 10 can also be mounted in the center of the fan 2, so that the fan blades 8 are driven directly from the central shaft of the motor 10.

As shown in FIGS. 12 and 15, grills 90 cover the open sides 88 of the housing 12. The mounting bracket 4 can be integrated into the grills 90 so that the grills support the central hub 6 and hold it in place with respect to the housing. Grill ports 92 are provided adjacent the downstream edge 18 of the front piece 28 and the upstream edge 16 of the back piece 32 for receiving fasteners connecting brackets 94. The brackets 94 may be flat plates or other shaped securement pieces that frictionally trap the grills 90 in place. The back piece 32 has an interior surface 98, and the grill ports 92 provided adjacent to the upstream edge 16 are connected to the interior surface 98. As best shown in FIG. 18, the front piece 28 has the interior surface 14 and the exterior surface 52, and the grill ports 92 provided adjacent the downstream edge 18 are located between the interior surface 14 and the exterior surface 52. In combination, the grills ports 92 and the brackets 94 provide one way that the grills 90 are secured relative to the housing 12.

Figure 14A:
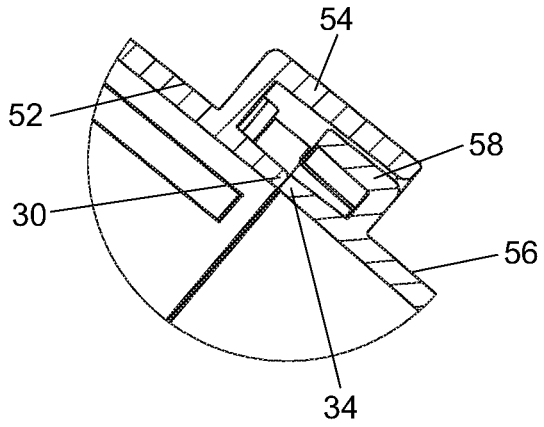
FIG. 14A is a cross-sectional view taken along line B-B of FIG. 12 providing detail about the alignment between the front and the back of the housing when the front and the back are connected.
Figure 14B:
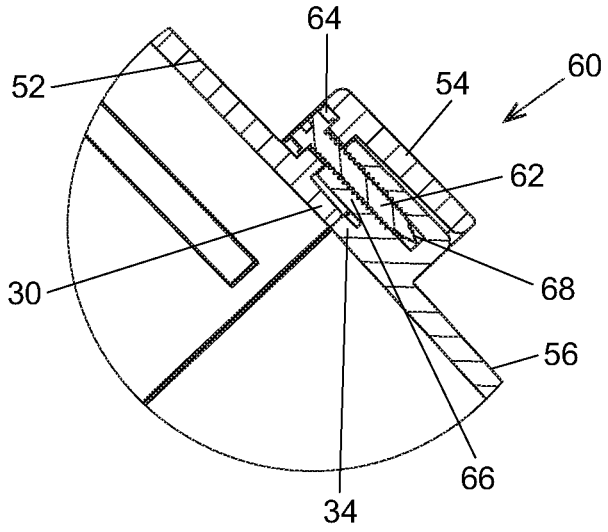
FIG. 14B is a cross-sectional view taken along line C-C of FIG. 12 providing detail about the connection between the front and the back of the housing.

As best shown in FIG. 14A, the second connecting edge 34 is configured to be connected to the first connecting edge 30. The inner lip 58 is configured for insertion below the outer lip 54 when the front piece 28 and the back piece 32 are connected. As seen in FIG. 6, housing connection ports 60 are used to attach the front piece 28 to the back piece 32. As best shown in FIG. 14B, each housing connection port 60 receives a fastener 62 for fastening the front piece 28 to the back piece 32. A first hole 64 is provided in the outer lip 54 of the front piece 28 for receiving the fastener 62. A fastening block 66 extends outwardly from the exterior surface 56 of the back piece 32 and is configured for insertion below the outer lip 54 of the front piece 28 when the front piece 28 and the back piece 32 are connected. The fastening block 66 includes a second hole 68 for receiving and holding the fastener 62. In other embodiments not depicted but within the scope of this disclosure, the fastening block 66 and outer lip 54 may not have first hole 64 or second hole 68 or fastener 62 but may instead be secured together by adhesives, spin welding, friction fit, spring action mechanism or other fastening method known in the art. The overlapping structure of the front piece 28 and back piece 32 provides strength to the housing 12, helping to prevent forces and torques on the exterior of the housing 12 from causing the housing 12 to bend or twist. Limiting twisting or deformation of the housing is particularly important when the housing 12 is formed from moldable materials, such as polymers or plastic, as plastic housings are particularly susceptible to deformation. The overlapping configuration of the inner lip 58 and the outer lip 54 increases the thickness of the housing 12 where the inner lip 58 and the outer lip 54 overlap, thereby providing additional strength to the housing 12. The fasteners 64, which may be formed of a sturdier material than plastic such as metal, provide further resistance to forces that could cause deformation of the housing of a conventional axial fan.

Figure 7:
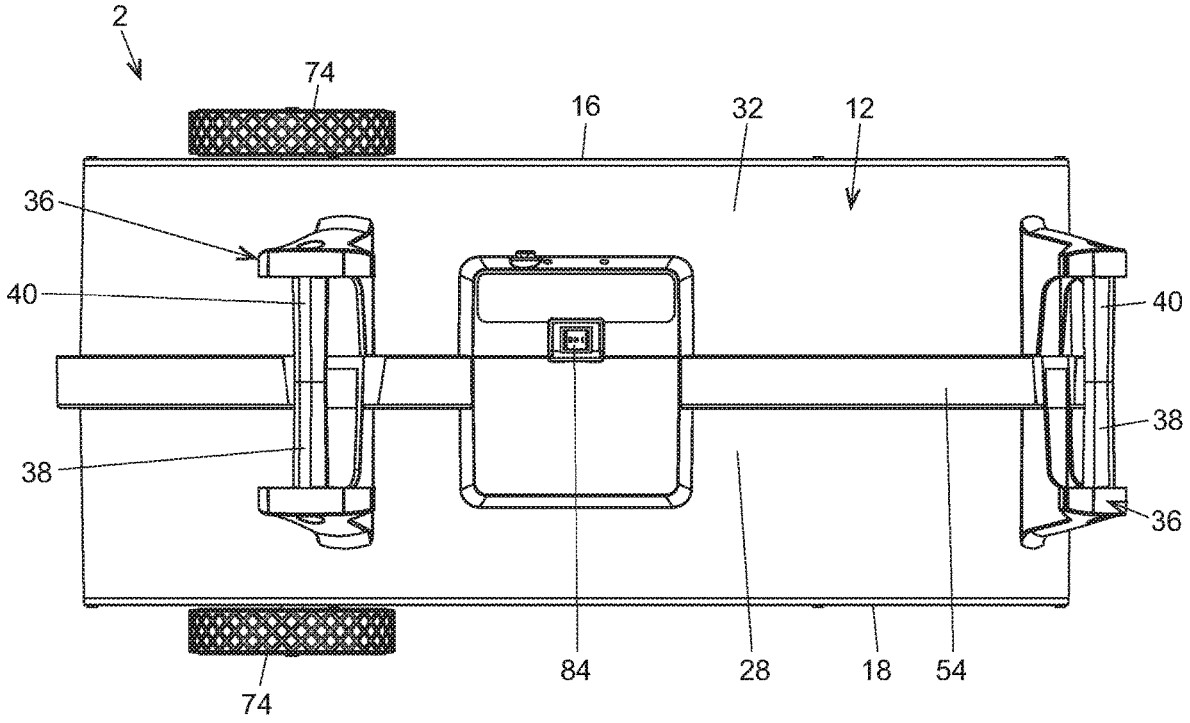
FIG. 7 is a top view of the fan depicted in FIG. 6.
Figure 8:
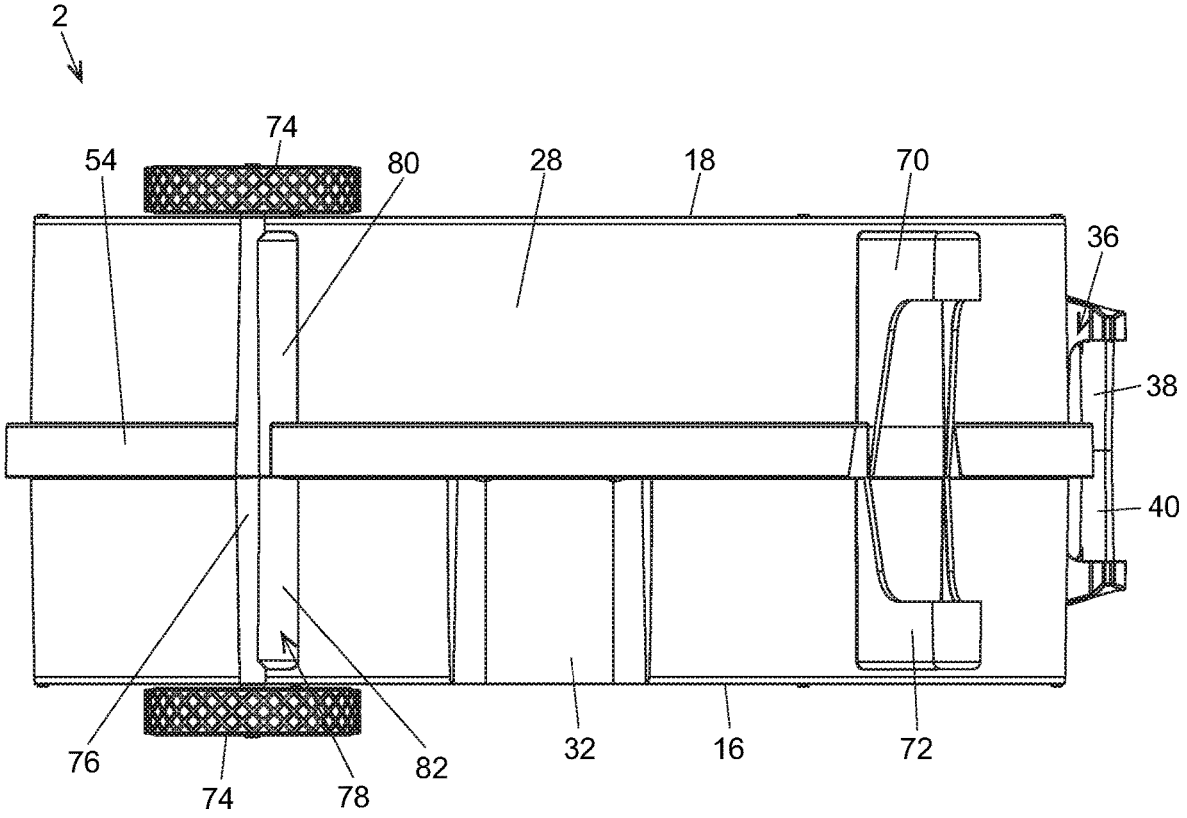
FIG. 8 is a bottom view of the fan depicted in FIGS. 6 and 7.
Figure 9:
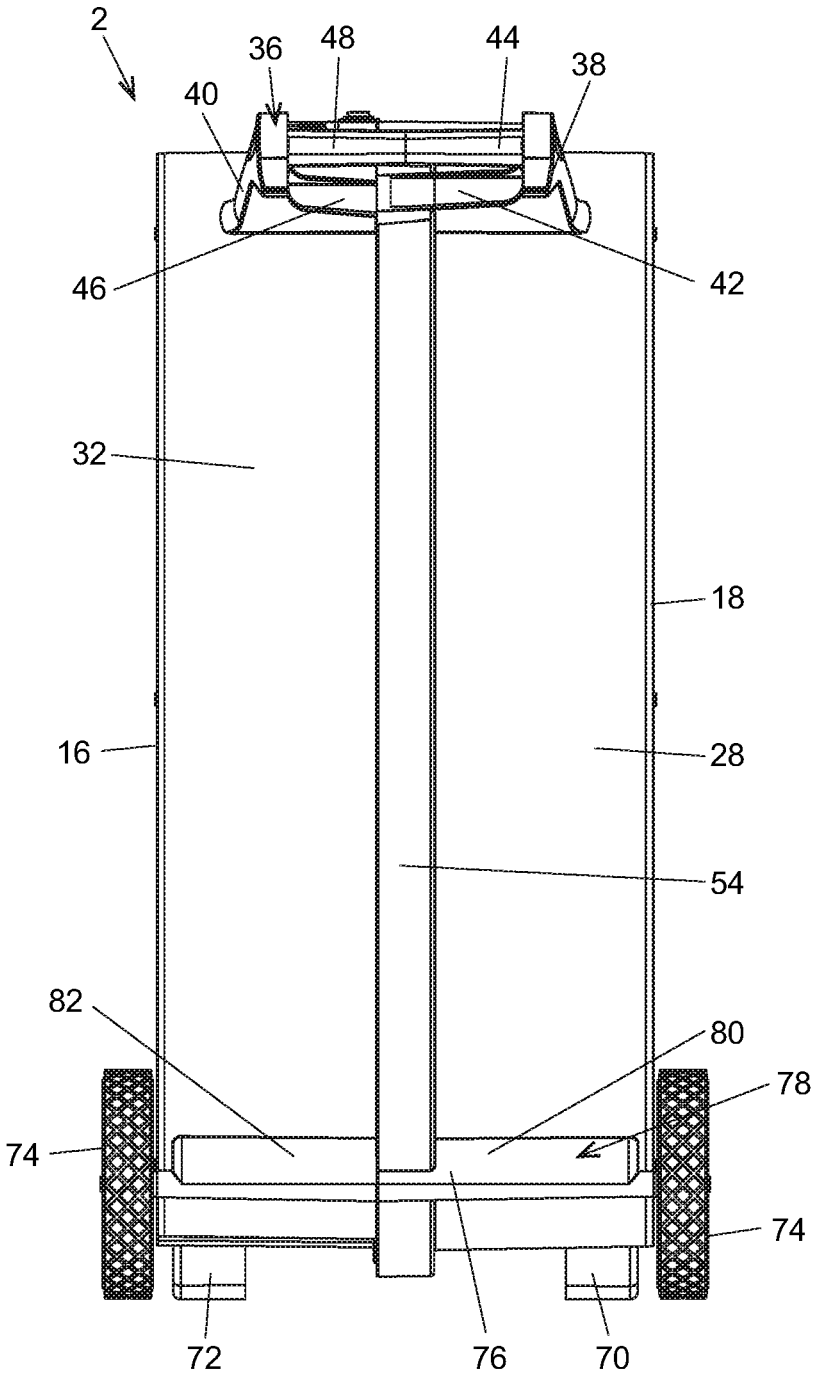
FIG. 9 is left side view of the fan depicted in FIGS. 6-8.
Figure 10:
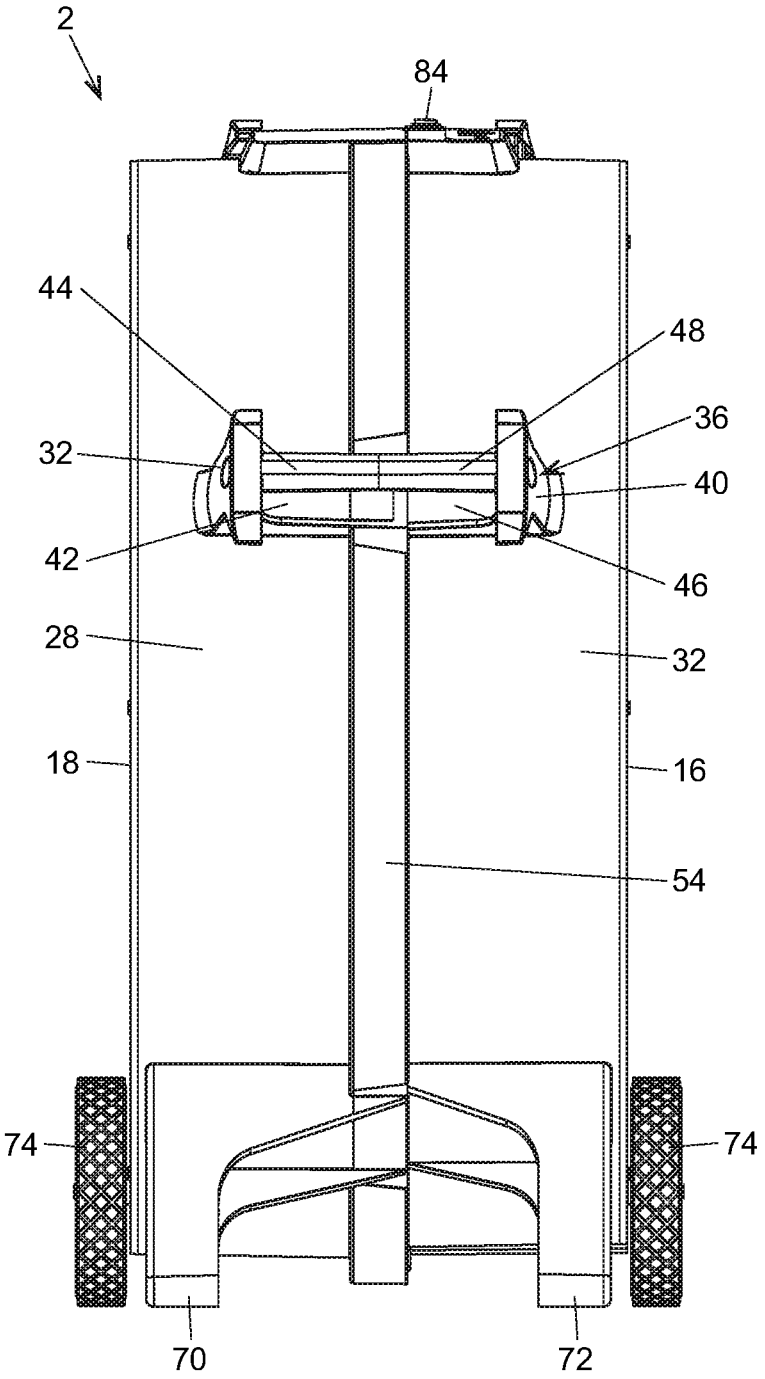
FIG. 10 is a right side view of the fan depicted in FIGS. 6-9.
Figure 11:
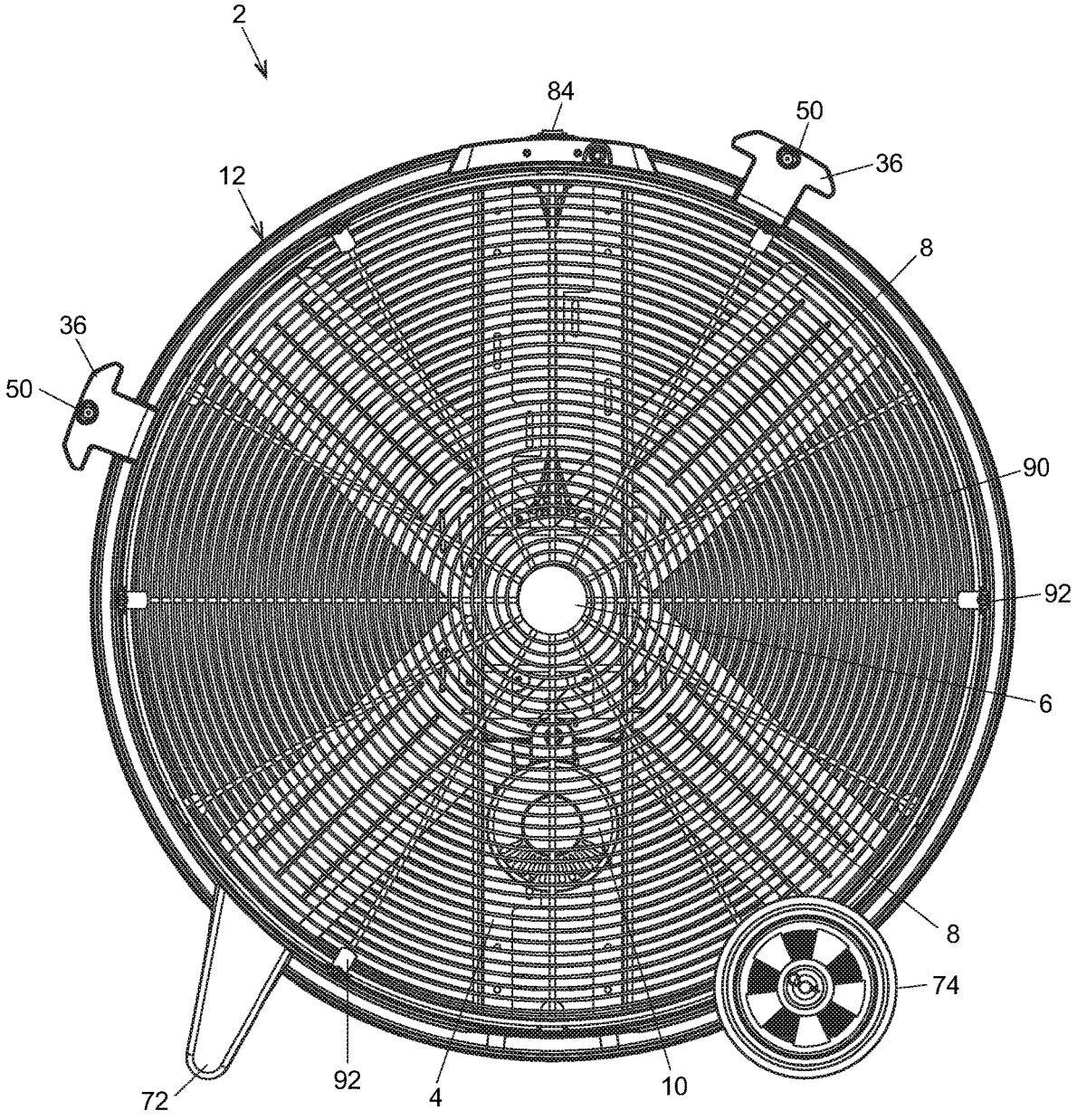
FIG. 11 is a back view of the fan depicted in FIGS. 6-10.
Figure 13:
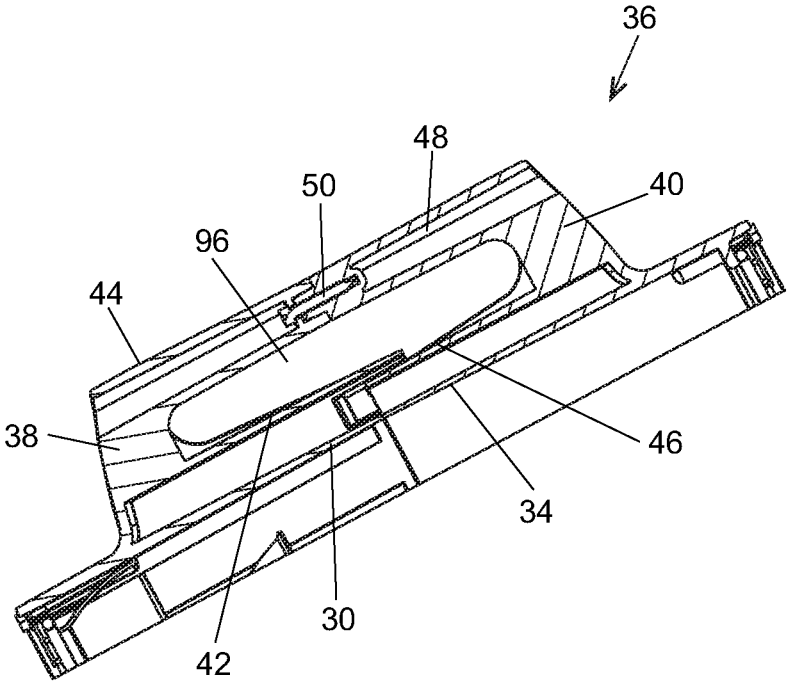
FIG. 13 is a cross-sectional view taken along line A-A of FIG. 12 providing detail about the handle of the fan.

Returning to FIG. 6, the fan 2 includes two handles 36. As shown in FIG. 7, each handle 36 has a first portion 38 integral with the front piece 28 and a second portion 40 integral with the back piece 32. The first portion 38 is configured to be attached to the second portion 40. As best shown in FIG. 13, each handle 36 includes an opening 96 through which it can be gripped. The first portion 38 has a bottom opening projection 42 and an upper opening projection 44. The second portion 40 has a bottom opening extension 46 and an upper opening extension 48. The bottom opening projection 42 and the bottom opening extension 46 overlap when the front piece 28 and the back piece 32 are attached to each other. The upper opening projection 44 is fastened to the upper opening extension 48 by a fastener 50. As shown in FIGS. 9, 10, and 15, the bottom opening projection 42 of the first portion 83 of the handle 36 is laterally adjacent to the outer lip 54 of the front piece 28, and the bottom opening projection 42 and the outer lip 54 extend an equal axial distance beyond the first connecting edge 30 of the front piece 28. The structure of the handle 36 provides additional strength to the housing 12, helping to prevent forces and torques on the exterior of the housing 12 from causing the housing 12 to bend or twist. The overlapping configuration of the handle 36 increases the thickness of the housing 12 at the handle 36, and this increased thickness provides additional strength to the housing 12. The fastening together of the first portion 38 and the second portion 40 further resists forces on the housing 12.

As shown in FIGS. 18 and 19, the front piece 28 comprises the interior surface 14 and the exterior surface 52. Air guide ribs 20 are provided on the interior surface 14. The air guide ribs 20 are axially aligned with the central hub 6 and extend from upstream of the fan blades 8 toward the downstream edge 16 of the front piece 28. The ramp 24 supported by struts 36 located between the interior surface 14 and the exterior surface 52 is also provided. The struts 36 are axially aligned with the central hub 6 and are distributed around the circumference of the front piece 28.

Figure 17B:
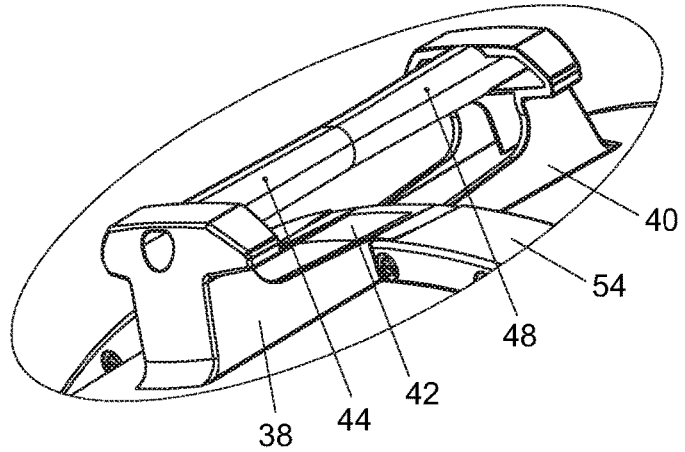
FIG. 17B is an enlarged section of the handle depicted in FIG. 17A.
Figure 17A:
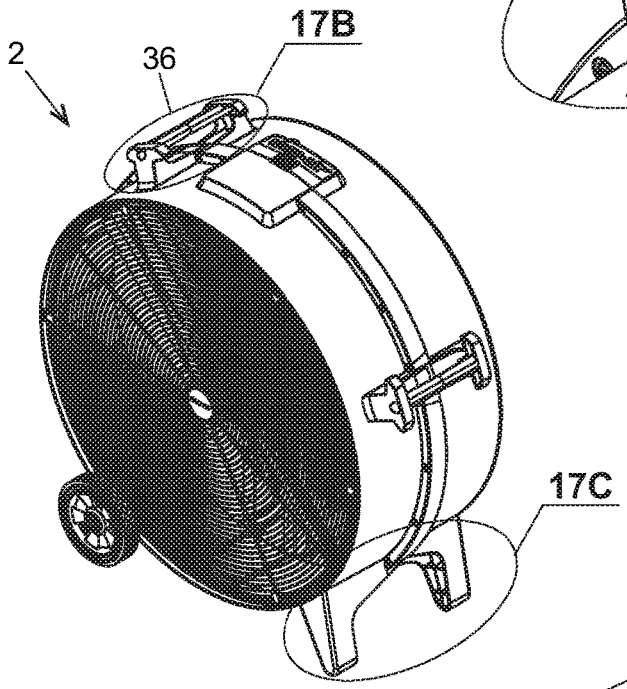
FIG. 17A is an isometric view of the fan depicted in FIGS. 6-17B illustrating the handle and feet of the fan.
Figure 17C:
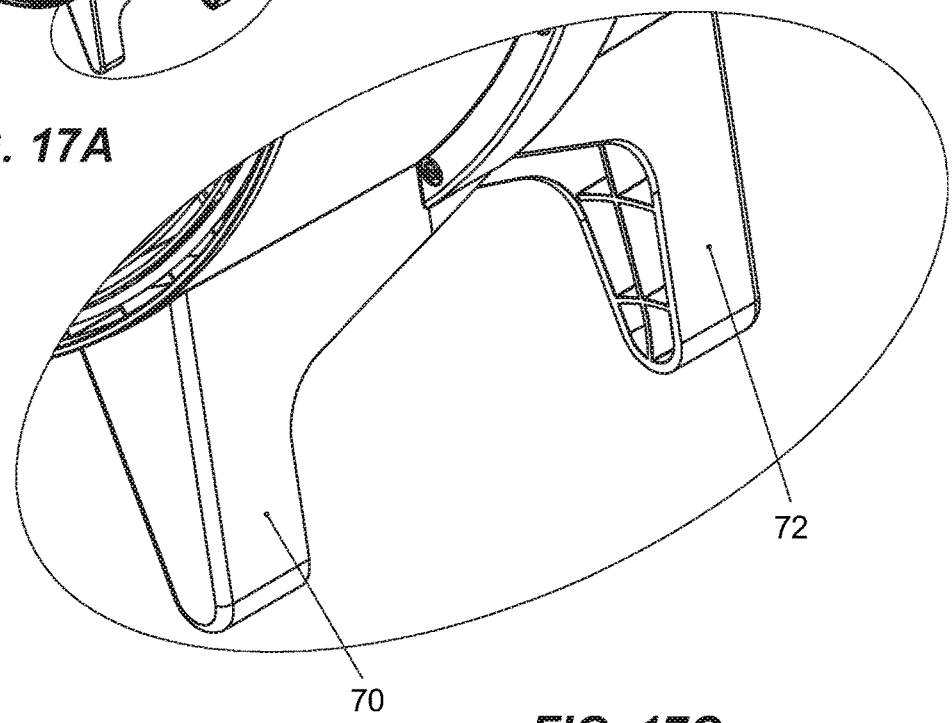
FIG. 17C is an enlarged section of the feet depicted in FIG. 17A.

Referring now to FIGS. 17A and 17C, the front piece 28 includes a first foot 70 integral with the front piece 28. The back piece 32 includes a second foot 72 integral with the back piece 32. The first foot 70 and the second foot 72 are aligned symmetrically when the front piece 28 and the back piece 32 are connected.

Figure 16A:
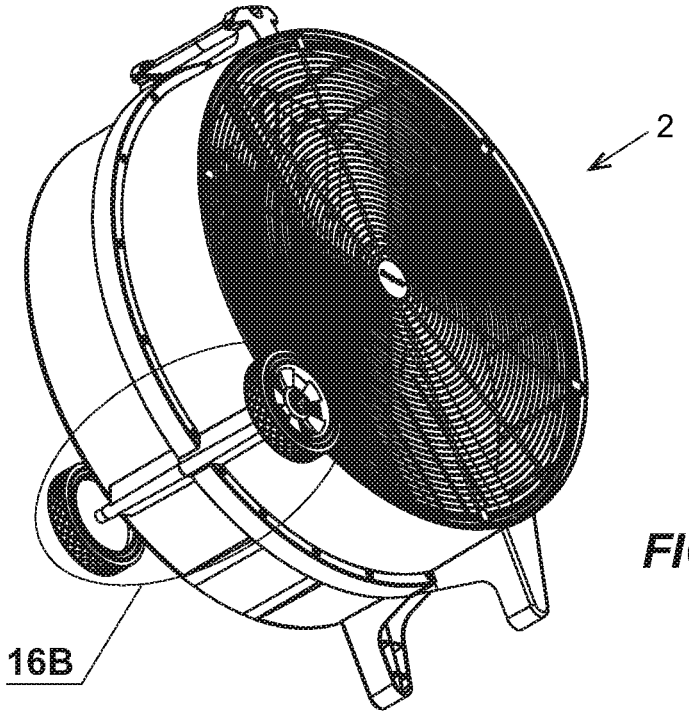
FIG. 16A is a bottom isometric view of the fan depicted in FIGS. 6-15 illustrating the wheels, axle, and axle bracket.
Figure 16B:
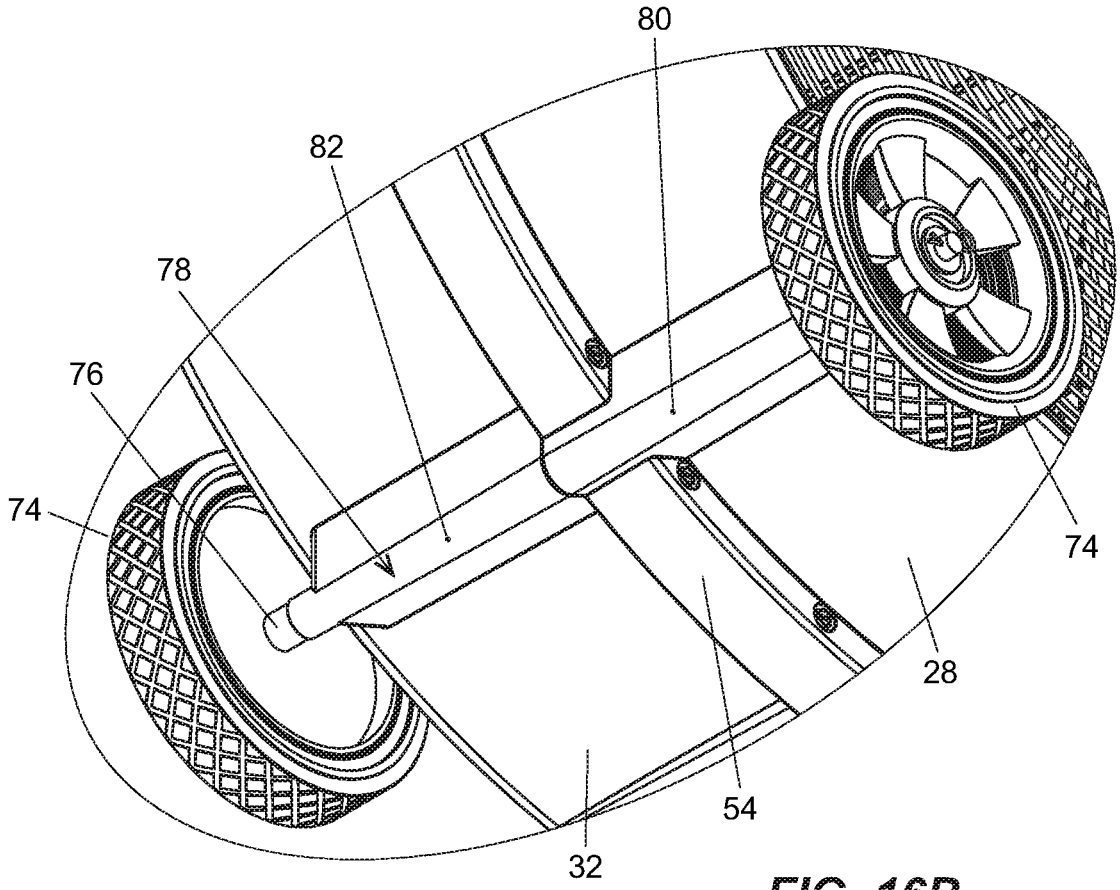
FIG. 16B is an enlarged section of the wheels, axle, and axle bracket depicted in FIG. 16A.

Referring now to FIGS. 16A and 16B, the fan 2 further includes two wheels 74 connected by an axle 76. The axle 76 extends through an axle bracket 78. The axle bracket 78 has a first section 80 integral with front piece 28 and a second section 82 integral with the second piece 32. The structure of the axle bracket 78, alone or in combination with the axle 76, contribute to the structural integrity of the housing 12. The increased thickness at the axle bracket 76 provides strength to the housing 12. The axle 76 itself, which may be made out of a sturdier material than plastic such as metal, provides further resistance to forces that could cause deformation of the housing of a conventional axial fan.

Referring again to FIG. 15, the fan 2 further comprises an on/off switch 84. The on/off switch 84 is connected to the motor 10. The on/off switch 84 is secured by a switch box in an aperture 86 in the back piece 32.

While particular arrangements of the present invention have been illustrated and described, it would be appreciated to those skilled in the art that various other changes and modifications can be made without departing from the spirit of the invention. It is therefore intended to cover in the appended claims all such changes and modifications.

What is claimed is:

1. A fan comprising:

a mounting bracket having a central hub;

fan blades rotatably connected to the central hub of the mounting bracket;

a motor operably connected to the fan blades; and a cylindrical housing surrounding the fan blades, the cylindrical housing having an interior surface connected to the mounting bracket, an exterior surface forming an outside of the cylindrical housing, an upstream edge in the direction of airflow, and a downstream edge in the direction of airflow, wherein the interior surface has a ramp starting at a location downstream of the upstream edge and ending at the downstream edge, wherein the ramp is supported by struts located radially exterior to the ramp between the interior surface and the exterior surface of the cylindrical housing that are axially aligned with the central hub and distributed around the circumference of the cylindrical housing, one or more of the struts at a bottom of the fan being thicker than one or more of the struts at the top of the fan.

2. The fan of claim 1, wherein the interior surface of the cylindrical housing has a width between the upstream edge and the downstream edge, and wherein the location at which the ramp starts is within a half of the width of cylindrical housing closest to the downstream edge.

3. The fan of claim 1, wherein a cross-sectional area inside the interior surface of the cylindrical housing at the upstream edge is greater than a cross-sectional area inside the interior surface of the cylindrical housing at the downstream edge.

4. The fan of claim 1, wherein the ramp is concave and has an initial angle between 0 and 5 degrees at the location where the ramp starts and a final angle between 30 and 40 degrees at the downstream edge.

5. A fan comprising:

a mounting bracket having a central hub;

fan blades rotatably connected to the central hub of the mounting bracket;

a motor operably connected to the fan blades;

a housing surrounding the fan blades, the housing having a front piece having a first connecting edge and a downstream edge, and a back piece separable from the front piece and having a second connecting edge and an upstream edge, the second connecting edge configured to be connected to the first connecting edge; and a handle having a first portion monolithic with the front piece of the housing and a second portion monolithic with the back piece of the housing, the first portion configured to be connected to the second portion, wherein the first portion of the handle having a bottom opening projection and an upper opening projection;

the second portion having a bottom opening extension and an upper opening extension;

the bottom opening projection and the bottom opening extension overlap when the front piece and the back piece are connected; and the upper opening projection is fastened to the upper opening extension by a fastener.

6. The fan of claim 5, wherein the front piece of the housing further comprises an exterior surface and an outer lip extending outwardly from the exterior surface of the front piece of the housing;

the back piece of the housing further comprising an exterior surface and an inner lip extending outwardly from the inner surface of the front piece and configured for insertion below the outer lip of the front piece when the front piece and back piece are connected; and the bottom opening projection of the first portion of the handle is adjacent to the outer lip of the front piece of the housing.

7. The fan of claim 6, wherein the bottom opening projection of the first portion of the handle and the outer lip extend an equal axial distance beyond the first connecting edge of the front piece of the housing.

8. The fan of claim 5, wherein the fan comprises two handles.

9. The fan of claim 5, wherein the motor drives a fan belt which rotates the fan blades.

10. A fan comprising:

a mounting bracket having a central hub;

fan blades rotatably connected to the central hub of the mounting bracket;

a motor operably connected to the fan blades; and a housing surrounding the fan blades, the housing having a front piece having a first connecting edge, a downstream edge, an exterior surface, and an outer lip extending outwardly from the exterior surface of the front piece, a back piece, the back piece separable from the front piece, the back piece having a second connecting edge, an upstream edge, an exterior surface, and an inner lip extending outwardly from the exterior surface of the back piece and configured for insertion below the outer lip of the front piece when the front piece and back piece are connected, and housing connection ports for fastening the front piece to the back piece with a separate fastener, wherein each housing connection port comprises a first hole in the outer lip of the front piece for the separate fastener, a fastening block extending outwardly from the exterior surface of the back piece and configured for insertion below the outer lip of the front piece when the front piece and back piece are connected, the fastening block comprising a second hole for the separate fastener, and two wheels connected by an axle, the axle extending through an axle bracket having a first section monolithic with the front piece and a second section monolithic with the back piece.

11. The fan of claim 10, the front piece further comprising a first foot integral with the front piece, the back piece further comprising a second foot integral with the back piece, wherein the first foot and the second foot are aligned symmetrically when the front piece and back piece are connected.

12. The fan of claim 10, the fan further comprising an on/off switch electrically connected to the motor, the on/off switch secured in an aperture in the back piece.

* * * * *